United States Patent [19]

Hrus et al.

[11] Patent Number: 4,619,296

[45] Date of Patent: Oct. 28, 1986

[54] WEFT INSERTING NOZZLE FOR JET LOOMS

[75] Inventors: Miroslav Hrus; Vladimir Svaty; Pavel Sidlof; Oldrich Fisar, all of Liberec, Czechoslovakia

[73] Assignee: Elitex, textilniho strojirenstvi, Liberec, Czechoslovakia

[21] Appl. No.: 768,952

[22] Filed: Aug. 23, 1985

[30] Foreign Application Priority Data

Aug. 23, 1984 [CS] Czechoslovakia ..... 6384-84

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,999,579 | 12/1976 | Ohkouchi et al. | 139/435 |
| 4,290,459 | 9/1981 | Manders | 139/435 |
| 4,494,888 | 1/1985 | Honda et al. | 139/435 |

FOREIGN PATENT DOCUMENTS

| | | | |
|---|---|---|---|
| 50-64573 | 5/1975 | Japan | 139/435 |

*Primary Examiner*—Henry S. Jaudon

[57] ABSTRACT

Nozzle for the insertion of weft thread in pnenumatic jet looms. The nozzle has a body in which there are disposed air channels and at least one weft thread guide. The air channels are disposed in the nozzle body so as to be adjustable with respect to the weft thread guide, whereby to produce a change in the rotation of the stream of air flowing through the nozzle.

5 Claims, 5 Drawing Figures

WEFT INSERTING NOZZLE FOR JET LOOMS

This invention relates to a nozzle for the insertion of weft threads in pneumatic jet looms. The nozzle of the invention comprises air channels and a weft guide arranged in the nozzle body.

Pneumatic jet looms are now widely used in the textile industry. A common feature of all such looms is the entry nozzle, the purpose of which is to draw the weft thread from the weft metering device and to transport it by an air stream into the shed of the loom. The air stream is usually fed into the nozzle through control valves, and it meets the weft thread in the nozzle mouth in the middle of which the weft thread is usually located, the air stream surrounding the weft thread in a space having the form of annulus.

The above-described prior art arrangement has some disadvantages. One of such disadvantages is the fact that the air stream is not correctly directed, and can thrust the weft thread out of the direction of its axis and also to cause by reason of this its untwisting or twisting. Some types prior art nozzles try to eliminate this affect so that the annulus is divided by a series of partition walls which create a system of channels. Another arrangement is known in which a system of air channels of circular or oval section is used. But all of such arrangements display a certain resulting rotation of the outgoing air stream which can be of an undesirable value or rotate in an undesirable direction.

The nozzle according to the present invention has among its objects the enablement of a continuous adjustment of the value and direction of rotation of the resulting air stream, thus to permit the resulting air stream to secure its optimum rotation for any specific condition of operation.

In accordance with the invention, the nozzle comprises air channels and a weft thread guide, the nozzle of the invention being particularly characterized by the fact that the air channels are adjustably located in the nozzle body with respect to the weft thread guide.

Other advantages and features of the invention will become evident from the exemplary embodiments illustrated in the drawings, wherein.

Figure 1:
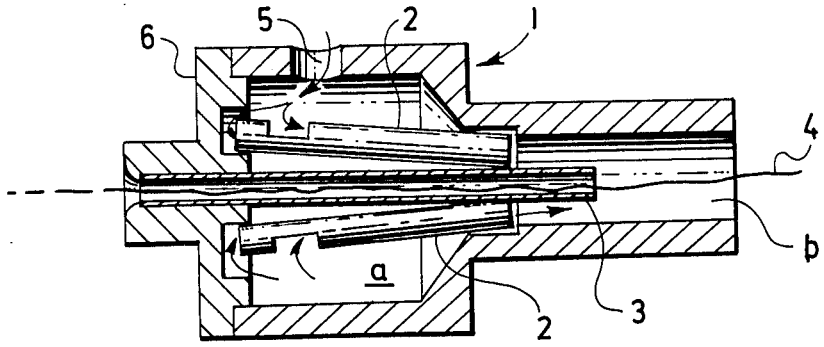
FIG. 1 is a view partially in vertical axial section and partially in side elevation of a first embodiment of nozzle in accordance with the invention.

Turning first to FIG. 1, the embodiment of nozzle there shown has a body 1 in which there are located a system of air channels which are, for example, a set of tubes 2 which surround the guide 3 designed to guide the weft thread 4. The system of tubes 2 is arranged so that the rear (left) end of the each of the tubes is swingably located in seats in the rear part 6 of the nozzle, and that the other (forward) end of the tubes is swingably mounted in seats in the nozzle body 1. Compressed air is fed through an inlet 5 into the space a within the body of the nozzle, and thereafter enters the air tubes 2. From the tubes 2, the compressed air flows into a common outlet space b, where it meets the weft thread 4. The rear part 6 of the nozzle is rotatable with respect to the main part of the nozzle body 1.

By the mutual turning of parts 1 and 6 relative to each other, the ends of the tubes 2 in the system of tubes are moved so that the axes of said tubes form elements of ruled surface on the surface of a one-part hyperboloid of revolution, the axis of which is identical with the axis of the guide 3 for the weft thread 4. In the central position of adjustment of the system of the tubes 2, the axes of the tubes are parallel and disposed in radial axial planes through the nozzle, so that the velocity of the air which emerges from it has no tangential component, and the outlet stream of the air does not rotate. By turning the system of tubes 2, their axes become skewed with respect to the axis of the weft thread guide tube 3, a tangential component appears in the velocity of the outgoing air, and outlet air stream rotates. Said rotation is continuously adjustable in both directions in dependence upon the value of the relative turning of the rear part 6 of the nozzle with respect to the nozzle body 1.

Figure 2:
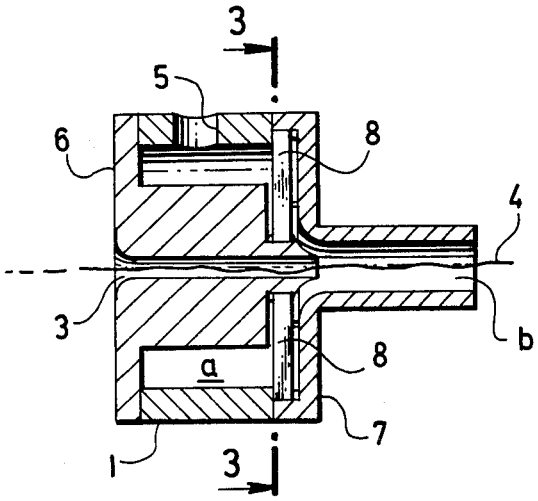
FIG. 2 is a view partially in vertical axial section and partially in side elevation of a second embodiment of the nozzle of the invention.
Figure 3:
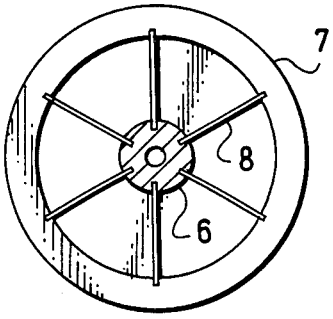
FIG. 3 is a view in transverse section through the nozzle of FIG. 2, the section being taken along the line 3—3 in FIG. 2.
Figure 4:
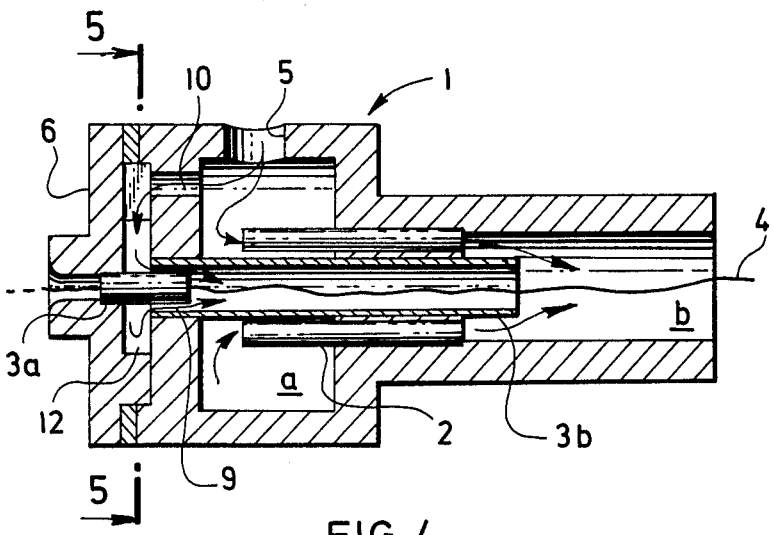
FIG. 4 is a view partially in vertical axial section and partially in side elevation of a third embodiment of nozzle in accordance with the invention.
Figure 5:
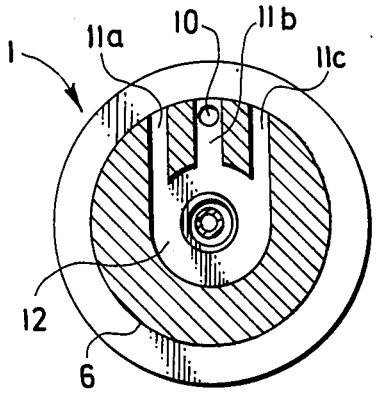
FIG. 5 is a view in transverse section through the nozzle of FIG. 4, the section taken along the line 5—5 in FIG. 4.

In FIGS. 2 and 3 illustrating a second embodiment of the invention and FIGS. 4 and 5, illustrating a third embodiment of the invention, parts which are similar to those in FIG. 1 are designated by the same reference characters.

Turning now to FIGS. 2 and 3, depicting a second embodiment of the invention, the nozzle is formed of a body 1, in which there is rotatably mounted a rear part 6 of the nozzle. Part 6 comprises a guide 3 for the weft thread 4. The front 7 of the nozzle is fixedly connected to the nozzle body 1. The system of the air channel in this embodiment is created by flexible directing wings or plates 8 which at their inner ends are located in the front central part 6' of the nozzle, and at their outer ends are located in pockets or slots 7' in the front part of the nozzle. Compressed air is fed through the inlet opening 5 into space a, from which it passes between the directing plates 8 into the common outlet space b, where it meets the weft thread 4.

By turning the rear part 6 of the nozzle with respect to the front part 7 thereof, the plates 8 are flexibly deformed and the air flowing from space a into the common outlet space b is directed so that, with regard to the axis of the nozzle, it obtains a tangential component of velocity and thus rotates. Said rotation is continuous within limits in both directions in dependence upon the mutual turning of the rear part 6 of the nozzle and the front 7 thereof.

The third illustrative embodiment of the nozzle of the invention, shown in FIGS. 4 and 5, is a double-nozzle. The internal nozzle is a rear guide 3*a* to guide the weft thread 4, guide 3*a* leading into the front guide 3*b*, which also guides the weft thread, both guides 3*a*, 3*b* form an annular gap 9 through which the compress air streams to meet the weft thread 4 in the front guide 3*b*. The external part of the nozzle is a system of channels formed by tubes 2 which are disposed parallel and surrounds the front guide 3*b*, the tubes 2 leading into a common outlet space b. Compressed air is fed into the space a of body 1 of the nozzle through the inlet opening 5. From said space, it flows on the one hand into the system of tubes 2 which are tightly fixed in body 1, and on the other hand, it flows into the opening 10. The rear part 6 of the nozzle, which is rotatably connected with body 1, is provided with three channels 11*a*, 11*b*, and 11*c* which lead into the annular space 12.

If the rear part 6 of the nozzle of FIGS. 4 and 5 are adjusted with respect to body 1 of the nozzle so that the axis of the central air channel 11*b* intersects the axis of the opening 10, comprises air flows symmetrically through the opening 10 and through the central channel 11*b* into the annular space 12 so that when entering the annular gap 9 the air stream does not rotate, and the outlet from the internal nozzle to the front guide 3*b* and the total outlet from the common outlet space b is non-rotational.

Wherein the rear part 6 of the nozzle is adjusted with respect to the body 1 so that either the opening 10 leaves non-symmetrically into the central channel 11*b* to lead the air, or if its leads into some the marginal air channels 11*a* and 11*c*, the stream of air inflowing into the annular space 12 is non-symmetrical, and when entering the annular gap 9 there is rotation of the air. The value and direction of said rotation depend upon the adjustment of rear part 6 of the nozzle with respect to the body 1 of the nozzle. In the outlet of the rotating air from the front guide 3*b* into the common outlet chambers b, into which the non-rotating air from the system of tubes also leads, there originates a resulting rotational motion of the outgoing stream of the air.

The illustrative methods and arrangements are only some of many possibility which follow the object of the invention, i.e. to enable the continuous control of the value and direction of rotation of the air stream entraining the weft thread.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A nozzle for the insertion of weft threads in pnenumatic jet looms, wherein means are provided to allow air to enter said nozzle and wherein said nozzle comprises a body in which there are disposed air channels into which the air enters and at least one weft thread guide arranged in the nozzle body, and means operable to cause the air to rotate and to produce a change in the direction and speed of rotation of the air passing through the nozzle, said last named means comprising means for adjusting the position of the air channels with respect to the weft thread guide.

2. A nozzle according to claim 1, wherein the air channels are formed by a system of tubes.

3. A nozzle according to claim 1, wherein the air channels are formed by at least one plate.

4. A nozzle according to claim 1, wherein the air channels are formed by flexible wings.

5. A nozzle according to claim 1, wherein the air channels are adjustable with respect to the plane of symmetry of the nozzle.

* * * * *